US006012822A

United States Patent [19]

Robinson

[11] Patent Number: 6,012,822

[45] Date of Patent: Jan. 11, 2000

[54] MOTION ACTIVATED APPAREL FLASHER

[76] Inventor: William J. Robinson, 1177 Duncan Dr., Manhattan Beach, Calif. 90266-6844

[21] Appl. No.: 08/756,493

[22] Filed: Nov. 26, 1996

[51] Int. Cl.[7] ..... F21L 15/08

[52] U.S. Cl. ..... 362/103; 362/800; 315/200 A; 36/137

[58] Field of Search ..... 362/84, 103, 105, 362/106, 108, 800; 315/200 A; 36/137

[56] References Cited

U.S. PATENT DOCUMENTS

| | | |
|---|---|---|
| 993,251 | 5/1911 | Howard . |
| 1,597,823 | 8/1926 | Randolph . |
| 1,908,662 | 5/1933 | Geier . |
| 1,933,243 | 10/1933 | Merolis et al. . |
| 2,258,543 | 10/1941 | Cressaty . |
| 2,347,665 | 2/1944 | Christensen et al. . |
| 2,480,800 | 8/1949 | Wickwire . |
| 2,557,663 | 6/1951 | Knode . |
| 2,572,760 | 10/1951 | Rikelman . |
| 2,580,258 | 12/1951 | Tarasuk . |
| 2,691,159 | 10/1954 | Heibel . |
| 2,849,819 | 9/1958 | Murphy et al. . |
| 2,854,563 | 9/1958 | Catching . |
| 2,931,012 | 3/1960 | Kosach . |
| 2,931,893 | 4/1960 | Arias et al. . |
| 3,008,038 | 11/1961 | Dickens et al. . |
| 3,070,907 | 1/1963 | Rocco . |
| 3,239,696 | 3/1966 | Berkhalter et al. . |
| 3,323,367 | 6/1967 | Searle . |
| 3,328,570 | 6/1967 | Balchunas . |
| 3,349,511 | 10/1967 | Aronoff . |
| 3,363,139 | 1/1968 | Schiavone . |
| 3,383,503 | 5/1968 | Montgomery . |
| 3,435,556 | 4/1969 | Clarke . |
| 3,549,878 | 12/1970 | Bailey . |
| 3,580,575 | 5/1971 | Speeth . |
| 3,582,691 | 6/1971 | Sonderegger . |
| 3,582,692 | 6/1971 | Palini . |
| 3,604,958 | 9/1971 | Pelini . |
| 3,610,916 | 10/1971 | Meehan . |
| 3,701,903 | 10/1972 | Merhar . |
| 3,720,918 | 3/1973 | Perl . |
| 3,737,647 | 6/1973 | Gomi . |
| 3,750,127 | 7/1973 | Ayers et al. . |
| 3,769,663 | 11/1973 | Perl . |
| 3,798,474 | 3/1974 | Cassand et al. . |
| 3,800,133 | 3/1974 | Duval . |

(List continued on next page.)

FOREIGN PATENT DOCUMENTS

| | | |
|---|---|---|
| 570614 | 9/1958 | Belgium . |
| 121026 | 10/1984 | European Pat. Off. . |
| 335467 | 10/1989 | European Pat. Off. . |
| 713490 | 10/1931 | France . |
| 1555306 | 1/1969 | France . |
| 2227714 | 11/1974 | France . |
| 2556190 | 6/1985 | France . |
| 2608485 | 9/1977 | Germany . |
| 2838770 | 3/1980 | Germany . |
| 3343897 | 6/1985 | Germany . |
| 489219 | of 1954 | Italy . |
| 58-195238 | 11/1983 | Japan . |
| 8006456 | 6/1982 | Netherlands . |
| 444392 | 4/1936 | United Kingdom . |
| 1092482 | 11/1967 | United Kingdom . |
| WO 81/02223 | 8/1981 | WIPO . |
| WO 87/02846 | 5/1987 | WIPO . |

OTHER PUBLICATIONS

John B. Peatman, The Design of Digital Systems, 1972, pp. 373, 376, 412, 413, 414, 415 and 416 (No Date).

*Primary Examiner*—Carroll B. Dority
*Attorney, Agent, or Firm*—Graham & James LLP

[57] ABSTRACT

A light flasher for an article of apparel includes one or more lamps that produce light visible from the exterior of the apparel. A switch, which may be of the mechanical or electronic variety, causes a switch closure responsive to motion of the apparel. A circuit, attached to the switch and the light, causes the lights to illuminate in a series of random duration flashes for a predefined time interval in response to the closure of the switch.

11 Claims, 4 Drawing Sheets

U.S. PATENT DOCUMENTS

| | | | |
|---|---|---|---|
| 3,808,418 | 4/1974 | Conard et al. . | |
| 3,828,177 | 8/1974 | Day . | |
| 3,893,247 | 7/1975 | Dana, III . | |
| 3,896,265 | 7/1975 | Hara et al. . | |
| 3,931,514 | 1/1976 | Patterson . | |
| 3,940,868 | 3/1976 | Northcutt . | |
| 3,946,505 | 3/1976 | Dana, III . | |
| 3,947,676 | 3/1976 | Battilana et al. . | |
| 3,967,142 | 6/1976 | Beach . | |
| 3,974,491 | 8/1976 | Sipe . | |
| 4,014,115 | 3/1977 | Reichert . | |
| 4,020,572 | 5/1977 | Chiaramonte, Jr. . | |
| 4,054,808 | 10/1977 | Tanaka . | |
| 4,064,429 | 12/1977 | Boehm . | |
| 4,112,601 | 9/1978 | Chiaramonte, Jr. . | |
| 4,128,861 | 12/1978 | Pelengaris . | |
| 4,130,951 | 12/1978 | Powell . | |
| 4,158,117 | 6/1979 | Quilliam et al. . | |
| 4,158,922 | 6/1979 | Dana, III . | |
| 4,164,008 | 8/1979 | Miller et al. . | |
| 4,185,621 | 1/1980 | Morrow . | |
| 4,216,403 | 8/1980 | Krempl et al. . | |
| 4,231,079 | 10/1980 | Heminover . | |
| 4,231,169 | 11/1980 | Toyama et al. . | |
| 4,250,650 | 2/1981 | Fima . | |
| 4,253,253 | 3/1981 | McCormick . | |
| 4,298,917 | 11/1981 | Ware . | |
| 4,304,126 | 12/1981 | Yelke . | |
| 4,328,441 | 5/1982 | Kroeger, Jr. et al. . | |
| 4,347,681 | 9/1982 | Fima . | |
| 4,367,515 | 1/1983 | Beard . | |
| 4,402,147 | 9/1983 | Wu . | |
| 4,406,040 | 9/1983 | Cannone . | |
| 4,423,473 | 12/1983 | Kirkley . | |
| 4,451,871 | 5/1984 | Kirkley et al. . | |
| 4,473,870 | 9/1984 | Sorenson . | |
| 4,480,293 | 10/1984 | Wells . | |
| 4,499,394 | 2/1985 | Koal . | |
| 4,510,704 | 4/1985 | Johnson . | |
| 4,523,258 | 6/1985 | Morse et al. . | |
| 4,523,261 | 6/1985 | West . | |
| 4,570,206 | 2/1986 | Deutsch . | |
| 4,595,200 | 6/1986 | Shishido . | |
| 4,595,864 | 6/1986 | Stiefelmeyer et al. . | |
| 4,599,682 | 7/1986 | Stephens . | |
| 4,602,191 | 7/1986 | Davila . | |
| 4,654,629 | 3/1987 | Bezos et al. | 315/200 A |
| 4,660,305 | 4/1987 | Medler et al. . | |
| 4,665,568 | 5/1987 | Stutes . | |
| 4,667,274 | 5/1987 | Daniel . | |
| 4,703,217 | 10/1987 | Ratzlaff et al. . | |
| 4,713,586 | 12/1987 | Chiang | 315/200 A |
| 4,729,068 | 3/1988 | Ohe . | |
| 4,737,134 | 4/1988 | Rumsey . | |
| 4,741,120 | 5/1988 | Cota et al. . | |
| 4,748,366 | 5/1988 | Taylor . | |
| 4,771,394 | 9/1988 | Cavanagh . | |
| 4,774,434 | 9/1988 | Bennion . | |
| 4,774,642 | 9/1988 | Janko et al. . | |
| 4,777,749 | 10/1988 | Leo, Sr. . | |
| 4,779,166 | 10/1988 | Tanaka et al. . | |
| 4,794,539 | 12/1988 | Ewing . | |
| 4,811,507 | 3/1989 | Blanchet . | |
| 4,814,661 | 3/1989 | Ratzlaff et al. . | |
| 4,824,107 | 4/1989 | French . | |
| 4,827,384 | 5/1989 | Von Schlemmer . | |
| 4,839,777 | 6/1989 | Janko et al. . | |
| 4,848,009 | 7/1989 | Rodgers . | |
| 4,875,144 | 10/1989 | Wainwright . | |
| 4,896,069 | 1/1990 | Rosenberg et al. . | |
| 4,901,211 | 2/1990 | Shen . | |
| 4,904,222 | 2/1990 | Gastgeb et al. . | |
| 4,935,851 | 6/1990 | Wood . | |
| 4,937,709 | 6/1990 | Yanagi et al. . | |
| 4,943,752 | 7/1990 | Todd et al. . | |
| 4,945,458 | 7/1990 | Batts et al. . | |
| 4,959,761 | 9/1990 | Critelli et al. . | |
| 4,975,809 | 12/1990 | Ku . | |
| 4,985,809 | 1/1991 | Matsui et al. . | |
| 4,991,068 | 2/1991 | Mickey . | |
| 4,991,150 | 2/1991 | Wixom . | |
| 4,998,186 | 3/1991 | Cocca . | |
| 4,999,936 | 3/1991 | Calamia . | |
| 5,019,438 | 5/1991 | Rapisarda . | |
| 5,033,112 | 7/1991 | Evanyk . | |
| 5,034,648 | 7/1991 | Gastgeb . | |
| 5,052,131 | 10/1991 | Rondini . | |
| 5,057,974 | 10/1991 | Mizobe . | |
| 5,111,366 | 5/1992 | Rife et al. . | |
| 5,113,325 | 5/1992 | Eisenbraun . | |
| 5,128,842 | 7/1992 | Kenmochi . | |
| 5,128,843 | 7/1992 | Guritz . | |
| 5,134,549 | 7/1992 | Yokoyama . | |
| 5,147,129 | 9/1992 | Ku . | |
| 5,151,679 | 9/1992 | Dimmick . | |
| 5,158,767 | 10/1992 | Cohen et al. . | |
| 5,177,812 | 1/1993 | DeMars . | |
| 5,178,447 | 1/1993 | Murase et al. . | |
| 5,188,447 | 2/1993 | Chiang et al. | 362/103 |
| 5,199,780 | 4/1993 | Ekman . | |
| 5,207,493 | 5/1993 | Murase et al. . | |
| 5,239,450 | 8/1993 | Wall . | |
| 5,245,516 | 9/1993 | de Haas et al. . | |
| 5,249,104 | 9/1993 | Mizobe . | |
| 5,249,106 | 9/1993 | Barnes et al. . | |
| 5,256,948 | 10/1993 | Bodin et al. | 315/200 A |
| 5,278,733 | 1/1994 | St. Thomas . | |
| 5,278,734 | 1/1994 | Ferber . | |
| 5,283,673 | 2/1994 | Murase et al. . | |
| 5,283,722 | 2/1994 | Koenen et al. . | |
| 5,283,911 | 2/1994 | DeMars . | |
| 5,283,968 | 2/1994 | Williams . | |
| 5,285,586 | 2/1994 | Goldston et al. . | |
| 5,303,131 | 4/1994 | Wu . | |
| 5,323,492 | 6/1994 | DeMars . | |
| 5,329,637 | 7/1994 | Walker . | |
| 5,381,615 | 1/1995 | MacMillan | 362/103 |
| 5,400,323 | 3/1995 | Wong . | |
| 5,408,764 | 4/1995 | Wut | 362/103 |
| 5,422,628 | 6/1995 | Rodgers . | |
| 5,430,621 | 7/1995 | Rascas . | |
| 5,438,488 | 8/1995 | Dion | 362/103 |
| 5,457,900 | 10/1995 | Roy | 362/103 |
| 5,500,635 | 3/1996 | Mott | 36/137 |
| 5,502,903 | 4/1996 | Baker . | |
| 5,546,681 | 8/1996 | Goldston . | |
| 5,552,971 | 9/1996 | Madden | 362/84 |
| 5,599,088 | 2/1997 | Chien . | |
| 5,611,621 | 3/1997 | Chien | 362/84 |
| 5,663,614 | 9/1997 | Weng et al. | 362/103 |
| 5,709,464 | 1/1998 | Tseng | 362/103 |
| 5,746,499 | 5/1998 | Ratcliffe et al. | 362/103 |

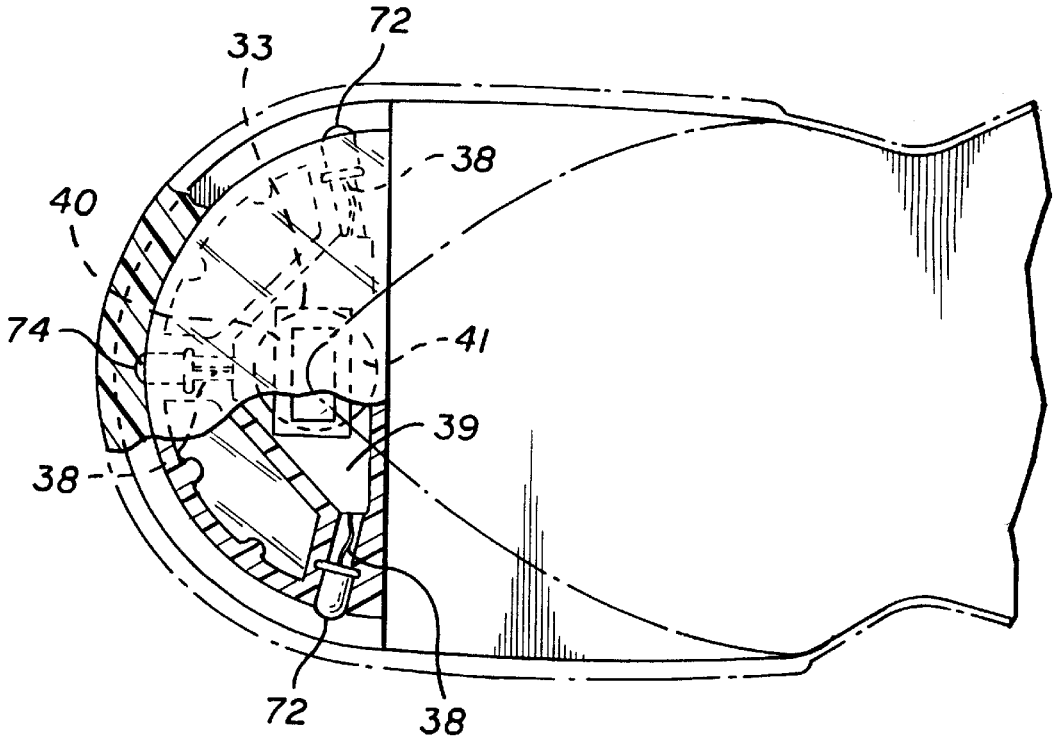
FIG. 5
FIG. 4
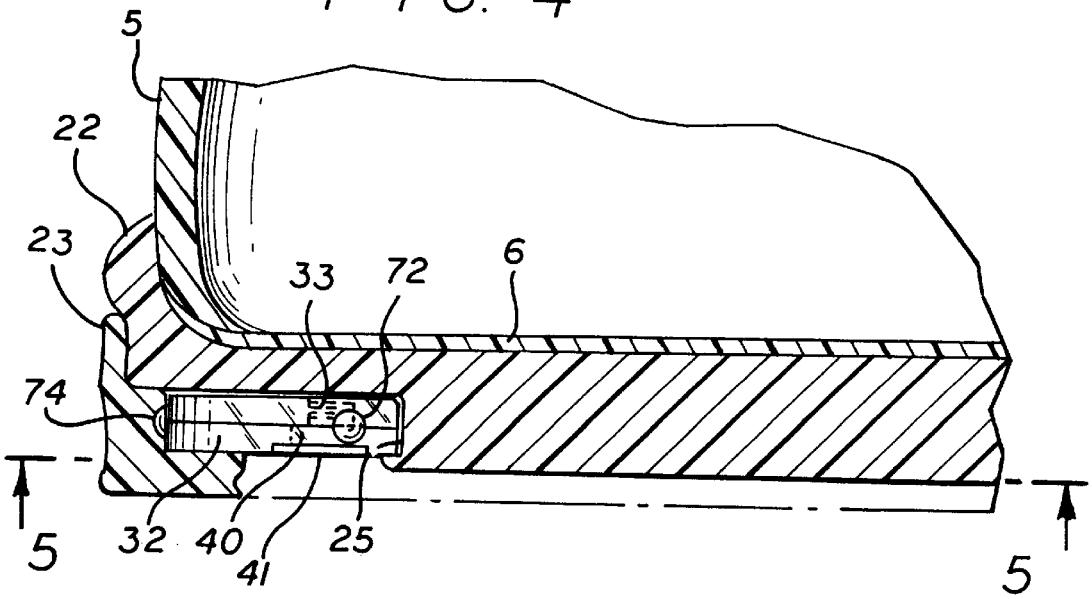

MOTION ACTIVATED APPAREL FLASHER

FIELD OF THE INVENTION

The present invention relates to apparel in general and, more particularly, to apparel with lights that randomly flash in response to motion to enhance the visibility of the apparel when worn.

BACKGROUND OF THE INVENTION

It is known to provide apparel with lights, as I discussed in my U.S. Pat. No. 5,546,681. Lighting devices have been incorporated into a variety of hats, shoes (including athletic shoes and dress shoes), for either safety reasons, such as allowing the wearer of the apparel to see or be seen in reduced light situations, or to provide special effects as an element of fashion on the part of the wearer.

Lighted footwear has been increasingly popular over the last several years. As I described in my prior patent, existing lighted footwear falls into several classes. The first is a simple on/off switch by which a light is connected to a battery responsively by a manually-operated switch. The second class is reflected in such patents as U.S. Pat. No. 4,158,122, issued to Dana, in which an on/off switch causes an oscillator to run, producing a regular pattern of flashing lights while the switch is closed.

A third class of device is motion activated lights. The prior art generally teaches one kind of motion activated light, as best illustrated by U.S. Pat. No. 4,848,009, issued to Rodgers. In this patent, in response to movement of the shoe, a switch is closed and a one-shot or monostable multivibrator causes a single pulse to issue in response to the closure of a switch. Until the pulse completes, further closures of the switch will have no effect, thereby eliminating the flickering of the light that would otherwise occur if the light was on for the small duration of time the motion switch was closed.

In my prior patent, I disclosed a new kind of lighted shoe that was a combination of a pressure switch coupled to a pair of monostable multivibrator circuits. In the arrangement disclosed therein, the circuit was designed to operate and cause a single flash for a predetermined length of time when the wearer of the shoe jumped or otherwise lifted his or her shoes from the ground. (A longer pulse occurred in a time-out situation where the shoe is lifted from the ground in a non-jumping motion.)

All the foregoing approaches are limited to either a continuous flashing operation, such as that disclosed in the Dana '922 patent, or to a pulse of predetermined duration, such as disclosed in the Rodgers '009 patent and in my prior patent.

For enhanced illumination effects, it would be preferable not to be limited to either a Dana-style oscillator or a Rodgers-style single pulse. A random flashing circuit, which has not been disclosed by the art, would enhance the visibility and the artistic effect of the flashing lights. This would be an entirely new approach to apparel lighting.

As discussed in my prior patent, any flashing unit used for apparel must be small and economical to make, and must be such as not to drain the battery prematurely. Any flashing unit must be such that when consumers are selecting lighted apparel, they can examine the operation of the flashing unit without having to put the apparel on. Thus, for example, consumers often purchase lighted shoes by picking them up from the display stand and shaking them and observing the lighted effect that occurs.

A random flashing shoe activated by a motion apparatus, all combined in a small package that could be mounted in an item of apparel such as a shoe or a hat that would operate with minimal battery drain, would also increase the salability of the shoes or other apparel.

SUMMARY OF THE INVENTION

The novel apparatus of the present invention overcomes the problems of the prior art described above and enhances both the visibility of the wearer, as well as the salability of the item itself, with the provision of a random flashing circuit activated by a switch responsive to motion. The flashing unit includes at least one light that produces light visible from the exterior of the apparel. A motion-responsive switch causes a switch closure when the apparel is moved. A circuit, attached between the light and the switch, causes the light to illuminate in a series of random pulses for a predetermined time internal in response to the switch closures.

In accordance with one aspect of the invention, the invention can be utilized with a variety of lights, such as light emitting diodes, incandescent lights, and electroluminescent panels.

Similarly, a variety of motion responsive switches can be utilized. Such switches would include mercury switches, piezoelectric transducer switches, and vibration switches of the type having a first contact on the end of a vibrating spring and a second contact which the first contact touches in response to motion imposed upon or the inertia change in the switch.

In accordance with yet another feature of the invention, the circuit includes a signal generator coupled to the lights that generates random width pulses. A monostable multivibrator, attached to the switch, enables the signal generator for a predetermined time interval in response to the switch closure.

The signal generator includes an oscillator that defines a clock signal, a shift register, and feedback logic, between the output and input of the shift register. The feedback logic loads the shift register such that the contents of the shift register are random. When the switch closes, the shift register is allowed to shift the random pulse stream through the register. The output of the register is then combined with the clock signal to produce a random pulse signal driving the lights.

The foregoing circuit is simple and reliable, and may be manufactured easily due to the low parts count. Since no power is drawn from the battery except when the switch is closed, power consumption is at a minimum.

A more complete understanding of the invention will be afforded to those skilled in the art, as well as a realization of additional advantages thereof, by a consideration of the following detailed description of the preferred embodiment. Reference will be made to the appended sheets of drawing which will first be described briefly.

BRIEF DESCRIPTION OF THE DRAWINGS

FIG. 4 is a side cutaway view of the footwear of FIG. 1 taken along lines 4—4;

FIG. 5 is a partial bottom sectional plan view taken along the lines 5—5 of FIG. 4;

DETAILED DESCRIPTION OF THE PREFERRED EMBODIMENT

Figure 1:
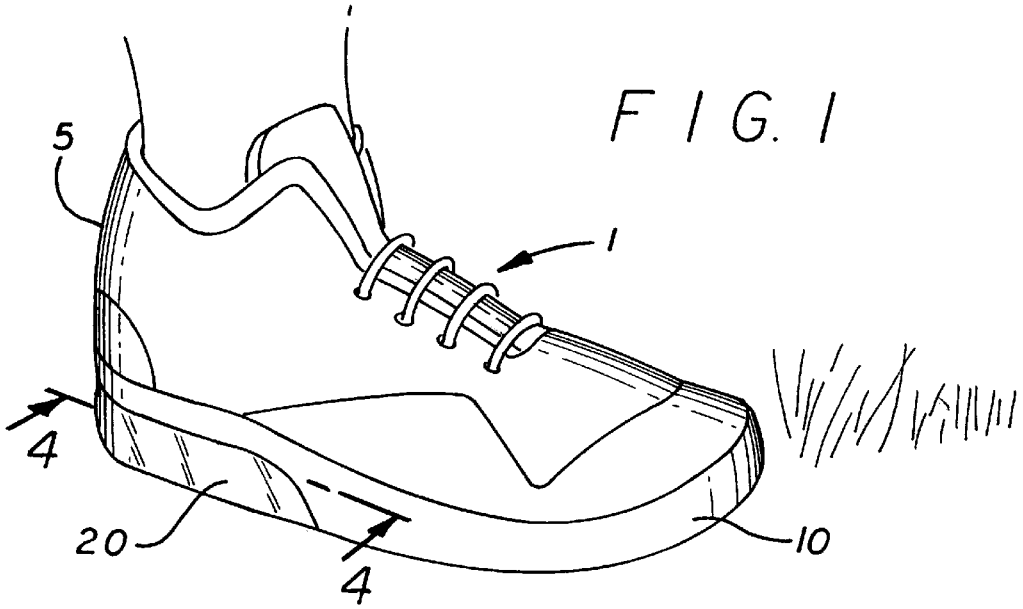
FIG. 1 is a side perspective view of the footwear which incorporates the novel lighting system of the present invention.
Figure 3:
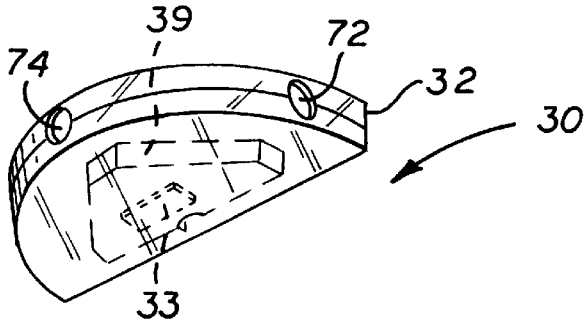
FIG. 3 illustrates a preferred embodiment of the lighting system of the present invention when installed in a shoe.
Figure 2:
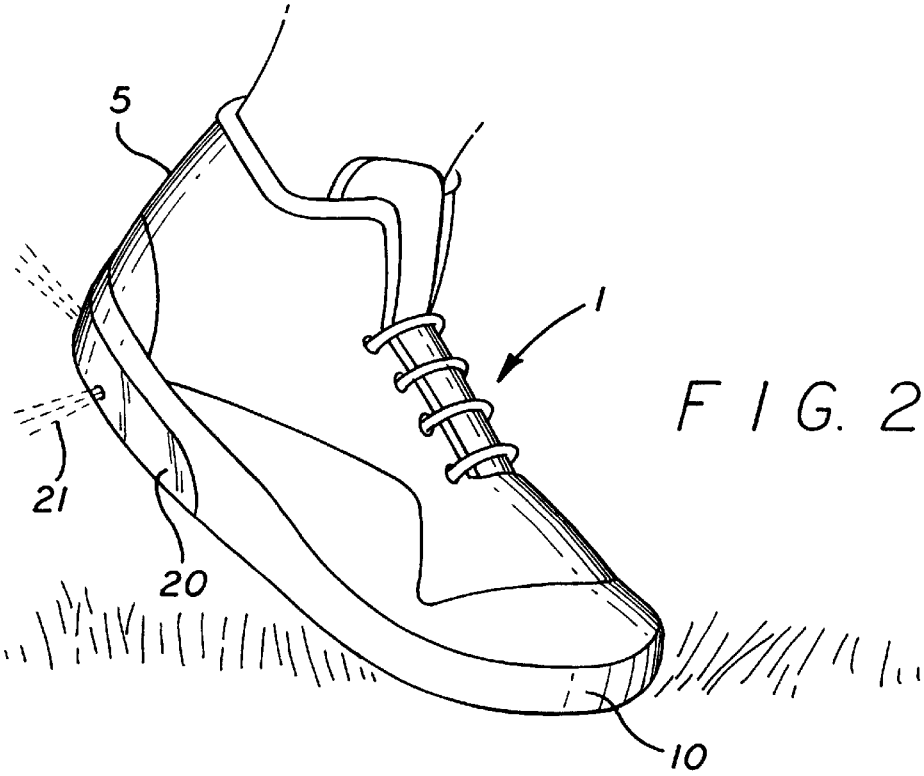
FIG. 2 is a side perspective view of the footwear of FIG. 1 showing the illumination of the lighting system of the present invention.

Referring more particularly to the drawings, the following discussion of the preferred embodiment and related process of the present invention focuses on shoes, and in particular the incorporation of the novel lighting system in an athletic shoe. It should be understood, however that the present invention is not limited to shoes, but all kinds of apparel that may be easily enclosed in hats, jackets, gloves and the like. The small nature of the module makes it adaptable for a wide range of apparel applications. Shoes, as reflected in FIGS. 1–5, are chosen for discussion purposes, only because of the challenge of using a small electronics package in the environment of a shoe. Other apparel applications are much simpler. FIGS. 1–5 illustrate no more than an application of the present invention.

Referring to FIGS. 1–5, an athletic shoe 1 typically includes an upper 5 and a sole portion 10. An insole 6 typically resides in an upper 5 above the sole portion 10. A transparent, window-like structure 20 is provided about a heel of the sole portion 10. The transparent structure 20 may be molded integral with the sole portion 10 or may be bonded thereto with a suitable adhesive. When the shoe is moved, visible light 21 is emitted from the transparent structure.

The sole portion 10 of the shoe 1 includes a mid-sole 22 and an outsole 23 which is fixably attached along the base of the shoe 1. As disclosed in my prior U.S. patent, the outer sole is typically formed from a solid, wear-resistant material such as rubber and certain polyuretane materials, whereas the mid-sole is typically formed in an injection or thermoformive process from a foamed resilient material such as polyurethane or ethylene vinyl acetate.

A light producing mechanism 30 is disposed in the midsole portion 10 of the shoe 1, preferably below the heel of the wearers' foot. The light producing mechanism 30 includes a plurality of light emitting diodes 72 and 74, (each can be multiple diodes) each is wired to a different part of the circuit. In the embodiment shown, the plurality of light emitting diodes are provided about the circumference of the housing 32, although other arrangements could certainly be utilized. The housing 32, which can be made from plastic or other suitable, resilient, yet solid material in an injection molding process, contains a lighting control circuit 33. Preferably, housing 32 is positioned within midsole 22 or immediately adjacent thereto so that LEDs 72, 74 are positioned next to the transparent source 20 thereby enabling light emitted by the LEDs 72, 74 to be visible externally of the shoe 1.

The lighting control circuit 33 is preferably disposed on a printed circuit board 39 to which the LEDs 31 are connected by conductors 38. A switch 40 is disposed within the housing 32 and is a motion sensitive switch that closes in response to motion of the shoe. The motion activated switch 40 may be a mercury switch, such as disclosed in the Rodgers '009 patent, a piezoelectric transducer of the type disclosed in Chiang U.S. Pat. No. 5,188,447, a vibration-type switch such as disclosed in Wut U.S. Pat. No. 5,408,764, a magnetic reed switch disclosed in Rodgers U.S. Pat. No. 5,422,628, or the vibration light switch disclosed in Wong, U.S. Pat. No. 5,400,232. The switch arrangements disclosed therein are hereby incorporated herein by reference. A simple mechanical momentary contact switch may also be utilized. The operative characteristics of all of these switches is a switch closure of the mechanical or electrical type in response to motion.

The lighting control circuit 33 is connected to a battery 41 which is located in the housing 32. While it is shown in the diagrams as being beneath the printed circuit board 39, the exact position is not important. The battery is electrically connected to the lighting control circuit shown in FIG. 6. The battery can be positioned at any convenient location within the housing.

Figure 6:
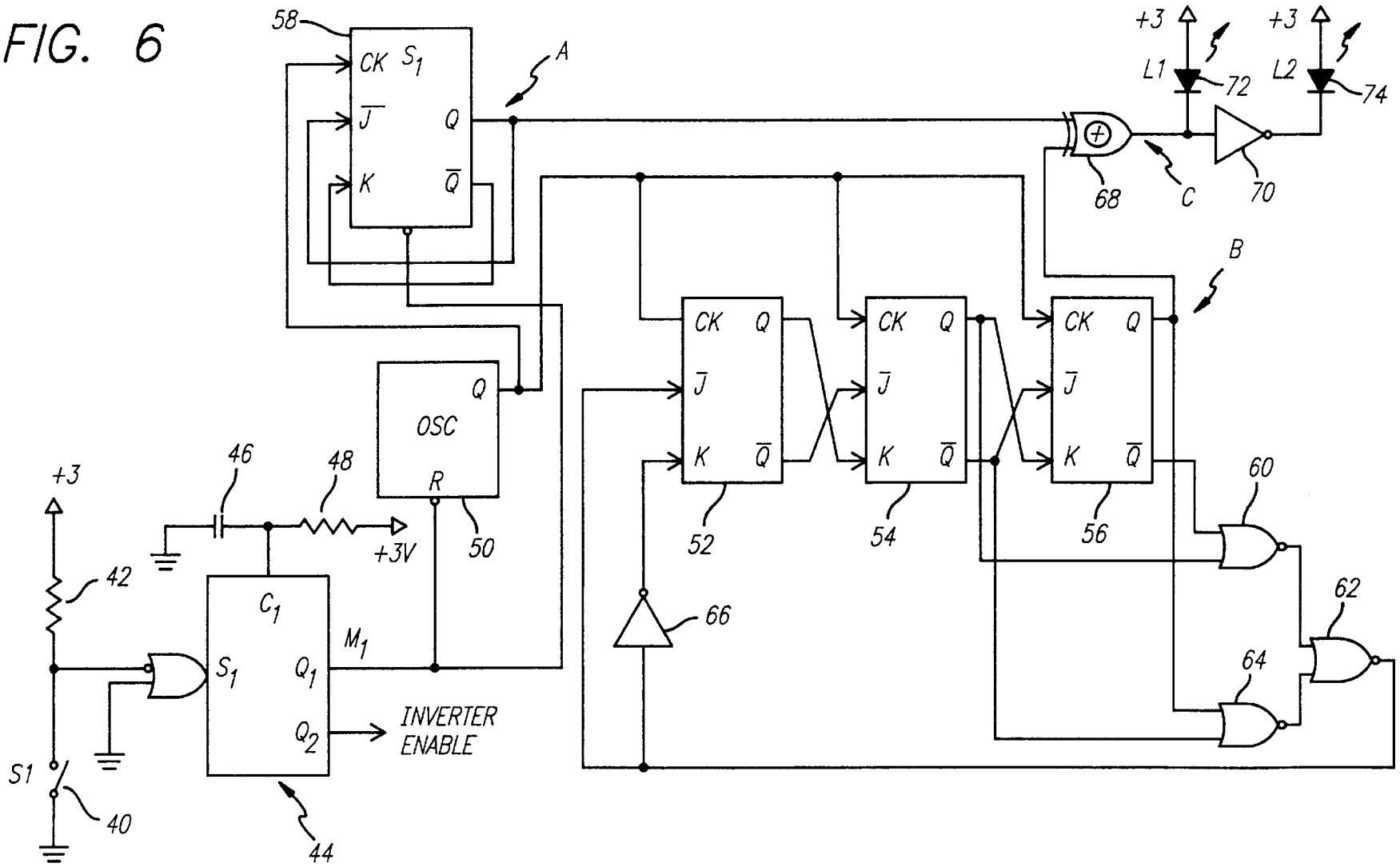
FIG. 6 is a schematic diagram of a preferred embodiment of the lighting control circuit show in FIG. 3.

As noted, the illumination of the LEDs 72, 74 is controlled by the lighting control circuit 33 shown in FIG. 6. The preferred embodiment is reflected therein. FIG. 6 uses a conventional "+3V" to indicate that a particular element is tied to a 3-volt power supply which would generally be provided by a dry cell, "button-type" lithium battery which provides extremely long life coupled with a light weight structure. Obviously, other forms and voltages of batteries could be utilized for the present invention. The motion switch 40 is tied to the input of a monostable multivibrator 44. This monostable multivibrator 44 is configured so as to trigger on a "negative" transition of the voltage at the switch 40, which occurs when the switch is closed. This results in the inverted input to the OR gate which forms a part of the multivibrator being tied to ground and the monostable multivibrator 44 producing a pulse at the output Q1 which is defined by external resistor 48 and capacitor 46. (The multivibrator can also be configured to work on a positive transition, such as a switch opening and it can also be configurerd to require a series of switch closures within a set time interval to trigger. Output Q2 is used to enable the outputs of inverters 66 and 70, which are of the buffered variety.

As described in my previous patent, the duration of the pulse out of monostable multivibrator 44 is controlled by the resistor and capacitor by forming an RC time constant network. Typical arrangements are a 47 $\mu$fd capacitor and a 2 MΩ resistor.

Figure 7:
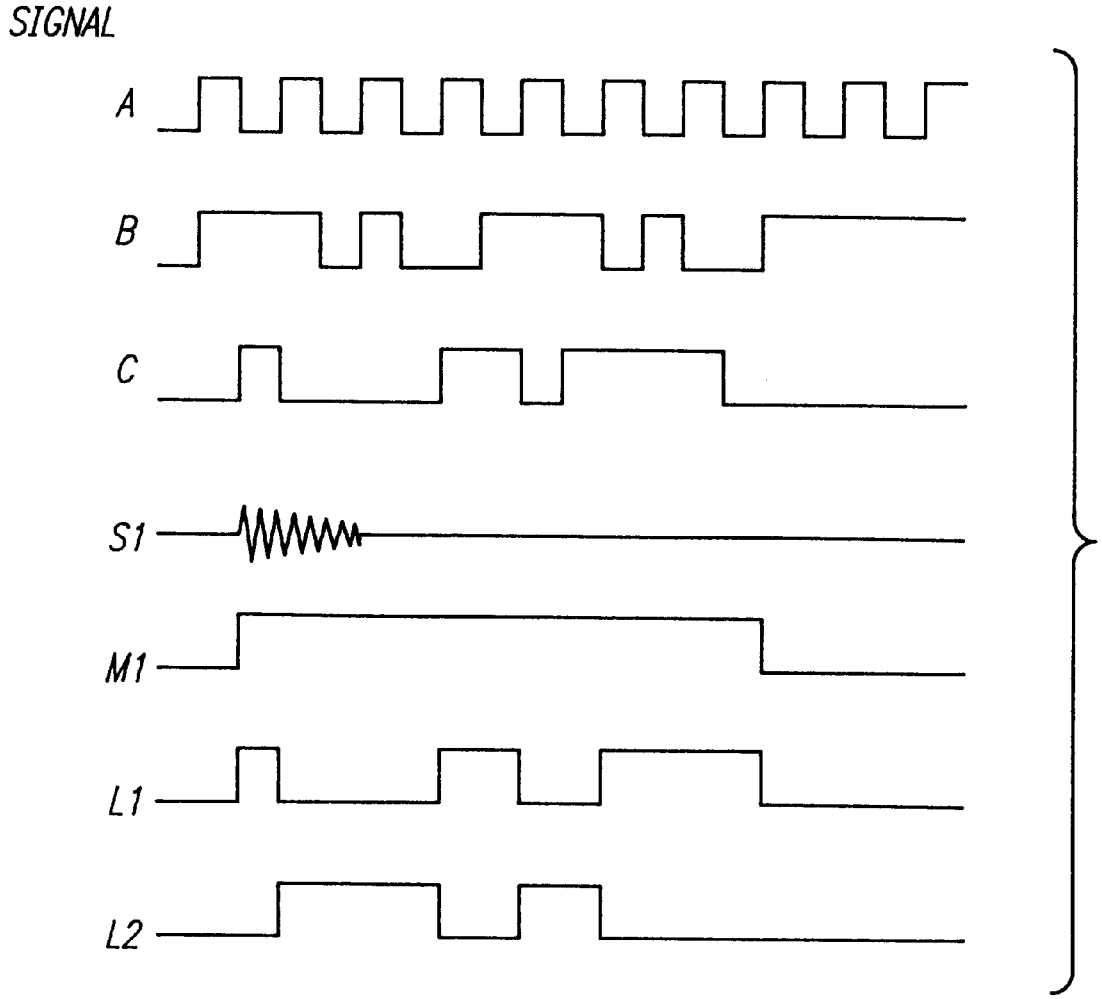
FIG. 7 is a timing diagram associated with the lighting circuit of the present invention as depicted in FIG. 6.

The output of the one shot is used to control a signal generator which produces random width pulses. Operation of the signal generator may be understood with reference to the timing diagrams in FIG. 7 and the circuit in FIG. 6. The timing diagram in FIG. 7 references a series of signal points A, B, C, S1, M1, L1 and L2. Signals A, B, and C are respectively the output of flip-flop 58, flip-flop 56, and exclusive-OR gate 68. S1 is the representation of the switch closure. M1 is the output of the one shot. L1 and L2 are the signals across the LEDs 72 and 74.

With reference to FIG. 6, the signal generator includes flip-flop 58, flip-flops 52–54 configured as a shift register, and 56, NOR gates 60, 62, and 64, inverter 66 and Exclusive OR 68. The purpose of flip-flop 58 is to divide the frequency of the oscillator. It is utilized to produce the appropriate control of the output of the shift registers through the exclusive OR gate 68.

The three flip-flops, 52, 54, and 56 shift the clock signals from the output of the oscillator 50. NOR gate 60 has one input connected to the reset output of flip-flop 56 and the other input is connected to the set output of flip-flop 54. A NOR gate 64 has one input connected to the set output of the flip-flop 56 and another input connected to the reset output of the flip-flop 54. The NOR gates 60 and 62 have their outputs connected to one input of a NOR gate 62 that also drives an inverter 66, forming an OR/NOR combination. The outputs of NOR gate 62 and inverter 66 are respectively connected to the set and reset inputs of flip-flop 52.

The output of the signal generator is provided at the output of flip-flop 56, otherwise indicated as signal point B. The output at signal point B is the random width pulses indicated in FIG. 7. Other random pulse variations can be achieved by changing the number of flip-flop circuits of the shift register and the input of the gate circuits connected in the feedback loop thereof. The output of the shift register at point B is then Exclusive OR'd with the output of flip-flop 58 so as to produce the signal at point C which is the random width pulse stream. An inverter 70 is used to invert this stream between LEDs 72 and 74 so that the lights can flash at opposite times. Random width circuits are known in the art and are usually used for data synchronization applications. See, e.g., U.S. Pat. No. 3,890,265 to Hara. No applications to apparel are known.

As mentioned, once the switch closes, the output of the one shot is activated and removes the reset signal from the input of the oscillator 50 and the frequency divider 58. Thus, the shift register continues to shift whatever random series of pulses have been loaded by the feedback loop. As soon as the one shot ends its duration, the shift register stops shifting and is frozen until the next switch closure.

The duration of the signals coming out of the shift register is controlled by oscillator 50. As mentioned, this can be two back-to-back one shots, so that the frequency can be controlled with an exterior resistor/capacitor combination. The length of time which the random sequence occurs is set by the resistor/capacitor combination on the one shot 44.

As can be seen, the foregoing circuit provides an easily programmable random width series of pulses to light the LEDs 72 and 74. Of course, one skilled in the art would readily appreciate that numerous other modifications and/or additions can be made to the above-discussed features of the present invention without departing from the spirit and scope of the present invention. In particular, the circuit can be made in integrated form or as an application specific integrated circuit. It is intended that the present invention encompass all such modifications.

What is claimed is:

1. A light flasher for an article of apparel, comprising:

light generating means for producing light visible from the exterior of said apparel;

switch means for causing switch closures responsive to motion of said apparel; and circuit means, coupled to said switch means and to said light generating means, for generating random lighting control signals to cause said light generating means to illuminate in a series of random-duration flashes for a predefined time interval in response to at least one of said switch closures.

2. A light flasher as defined in claim 1, wherein said light generating means comprises one or more light emitting diodes.

3. A light flasher as defined in claim 1, wherein said light generating means comprises one or more electroluminescent panels.

4. A light flasher as defined in claim 1, wherein said switch means comprises:

contact means, disposed in a sealed container, forming a pair of contacts; and, liquid mercury, also disposed in said container, for engaging and shorting said contacts in response to motion of said apparel.

5. A light flasher as defined in claim 1, wherein said switch means comprises:

first contact means forming a fixed contact; and, second contact means, resiliently biased away from said first contact means, for temporarily contacting said first contact means in response to movement of said apparel.

6. A light flasher as defined in claim 1, wherein said switch means comprises:

piezoelectric transducer means for generating the electrical equivalent of a mechanical switch closure in response to motion of said apparel.

7. A light flasher as defined in claim 1, wherein said circuit means comprises:

signal generator means, coupled to said light generating means, for generating said random lighting control signals;

monostable multivibrator means, coupled to said switch means, for enabling said signal generator means for a predetermined time interval responsive to at least one of said switch closures.

8. A light flasher as defined in claim 7, wherein said signal generator means comprises:

oscillator means for defining a clock signal;

shift register means, coupled to said oscillator means, for shifting pulses, said random lighting control signals being an output of said shift register means; and feedback logic, coupled between the output and input of said shift register means, for loading the input of said shift register means, whereby the contents of said shift register are random.

9. A light flasher as defined in claim 1, wherein said light generating means comprises:

a first source of light coupled to said circuit means; and a second source of light coupled to said circuit means in opposite phase to said first source of light, whereby said first and second sources generate light at opposite times.

10. A light flasher for an article of apparel, comprising:

switch means, disposed on said apparel, for causing a switch closure;

light generating means, coupled to said switch means, for producing control signals that cause random-duration flashes for a definable time interval in response to at least one of said switch closures.

11. (Amended) A method for producing random light flashes from an article of apparel, comprising:

sensing motion of said apparel;

generating a series of random width control signals in response to said sensed motion; and using said control signals to light at least one light.

* * * * *